US009160084B2

(12) United States Patent
Saitou et al.

(10) Patent No.: US 9,160,084 B2
(45) Date of Patent: Oct. 13, 2015

(54) CONNECTOR

(75) Inventors: Takahiko Saitou, Yokkaichi (JP); Yukihiro Fukatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/354,811

(22) PCT Filed: May 28, 2012

(86) PCT No.: PCT/JP2012/063621

§ 371 (c)(1),
(2), (4) Date: Sep. 19, 2014

(87) PCT Pub. No.: WO2013/061643

PCT Pub. Date: May 2, 2013

(65) Prior Publication Data

US 2015/0037995 A1 Feb. 5, 2015

(30) Foreign Application Priority Data

Oct. 28, 2011 (JP) ..... 2011-237640

(51) Int. Cl.

| | |
|---|---|
| ***H01R 13/42*** | (2006.01) |
| ***H01R 9/26*** | (2006.01) |
| ***H01R 13/422*** | (2006.01) |
| ***H01R 43/18*** | (2006.01) |
| ***H01R 13/46*** | (2006.01) |
| ***H01R 13/62*** | (2006.01) |

(52) U.S. Cl.

CPC ..... *H01R 9/2666* (2013.01); *H01R 13/4223* (2013.01); *H01R 13/46* (2013.01); *H01R 13/62* (2013.01); *H01R 43/18* (2013.01)

(58) Field of Classification Search

CPC .. H01R 9/2666; H01R 4/5083; H01R 4/4827; H01R 13/4223

See application file for complete search history.

(56) References Cited

U.S. PATENT DOCUMENTS 4,654,580 A * 3/1987 Keller ..... 324/525
5,627,473 A * 5/1997 Takani ..... 324/538

(Continued)

FOREIGN PATENT DOCUMENTS

JP 07-130441 5/1995
JP 11-045761 2/1999

(Continued)

OTHER PUBLICATIONS

European Patent Appl. No. 12 843 098.0—Partial European Search Report issued Jun. 5, 2015.

(Continued)

*Primary Examiner* — James Harvey

(74) *Attorney, Agent, or Firm* — Gerald E. Hespos; Michael J. Porco; Matthew T. Hespos

(57) ABSTRACT

A housing structure is prevented from becoming complicated. A connector (A) includes: a housing (10) having a terminal accommodation chamber (11); a terminal fitting (20) inserted into the terminal accommodation chamber (11); a lance (14) which can lock the terminal fitting (20) in a detachment prevention state; a front retainer (30); a mold removal space (19) which serves to mold the lance (14); and a detection hole (35) formed in the front retainer (30), allowing insertion of a probe P from the front side and communicating with the terminal accommodation chamber (11) via the mold removal space (19).

4 Claims, 17 Drawing Sheets

(56) References Cited

U.S. PATENT DOCUMENTS

| | | | | |
|---|---|---|---|---|
| 6,123,574 | A | 9/2000 | Matsuda et al. | |
| 6,332,803 | B1 | 12/2001 | Matsuda et al. | |
| 6,354,867 | B1 | 3/2002 | Tachi et al. | |
| 2002/0102877 | A1* | 8/2002 | Nankou | 439/595 |
| 2003/0199206 | A1* | 10/2003 | Mase et al. | 439/752 |
| 2007/0212950 | A1* | 9/2007 | Morello | 439/752 |
| 2008/0100306 | A1 | 5/2008 | Mizutani | |
| 2009/0042438 | A1* | 2/2009 | Iwahori et al. | 439/521 |
| 2010/0273366 | A1 | 10/2010 | Okano | |
| 2013/0295794 | A1* | 11/2013 | Nemoto | 439/595 |

FOREIGN PATENT DOCUMENTS

| | | |
|---|---|---|
| JP | 2001-110526 | 4/2001 |
| JP | 2004-037164 | 2/2004 |
| JP | 2008108588 | 5/2008 |
| KR | 20080079518 | 9/2008 |

OTHER PUBLICATIONS

International Search Report of Aug. 13, 2012.

* cited by examiner

CONNECTOR

BACKGROUND

1. Field of the Invention

The present invention relates to a connector.

2. Description of the Related Art

JP 2001-110526 A discloses a connector which accommodates a terminal fitting in a terminal accommodation chamber of a housing and which maintains the terminal fitting in a detachment prevention state by a front retainer mounted to the housing so as to cover the front surface thereof. In this connector, to perform a conduction inspection, a detection hole is formed in the front retainer, and a communication hole establishing communication between the detection hole and the terminal accommodation chamber is formed in the housing. When a probe for the conduction inspection is inserted into the detection hole from the front side of the front retainer, the probe passes the connection hole to come into contact with the terminal fitting in the terminal accommodation chamber.

In the connector disclosed in JP 2001-110526 A, a dedicated communication hole is formed in the housing in order to establish communication between the detection hole of the front retainer and the terminal accommodation chamber. Thus, the structure of the housing is rather complicated.

The present invention has been made in view of the above problem; it is an object of the present invention to prevent the housing structure from becoming complicated.

SUMMARY OF THE INVENTION

As a means for achieving the above object, the present invention provides a connector that includes: a housing having a terminal accommodation chamber; a terminal fitting accommodated in the terminal accommodation chamber; a lance which is formed so as to extend forwards in a cantilever-like fashion along an inner wall surface of the terminal accommodation chamber and which can lock the terminal fitting in a detachment prevention state; a front retainer mounted to the housing so as to cover a front surface thereof to thereby maintain the lance in a state where the lance is locked to the terminal fitting; a mold removal space which is formed in the housing and opened in the front surface of the housing, and which communicates with the terminal accommodation chamber and serves to mold the lance; and a detection hole formed in the front retainer, allowing insertion of a probe for conduction inspection from a front side of the front retainer, and communicating with the terminal accommodation chamber via the mold removal space.

This connector utilizes an existing mold removal space formed in order to mold the lance as a means for establishing communication between the detection hole of the front retainer and the terminal accommodation chamber, so that there is no need to newly form a communication hole dedicated to the probe. Thus, it is possible to prevent the configuration of the housing from becoming complicated.

DETAILED DESCRIPTION OF THE PREFERRED EMBODIMENTS

Figure 1:
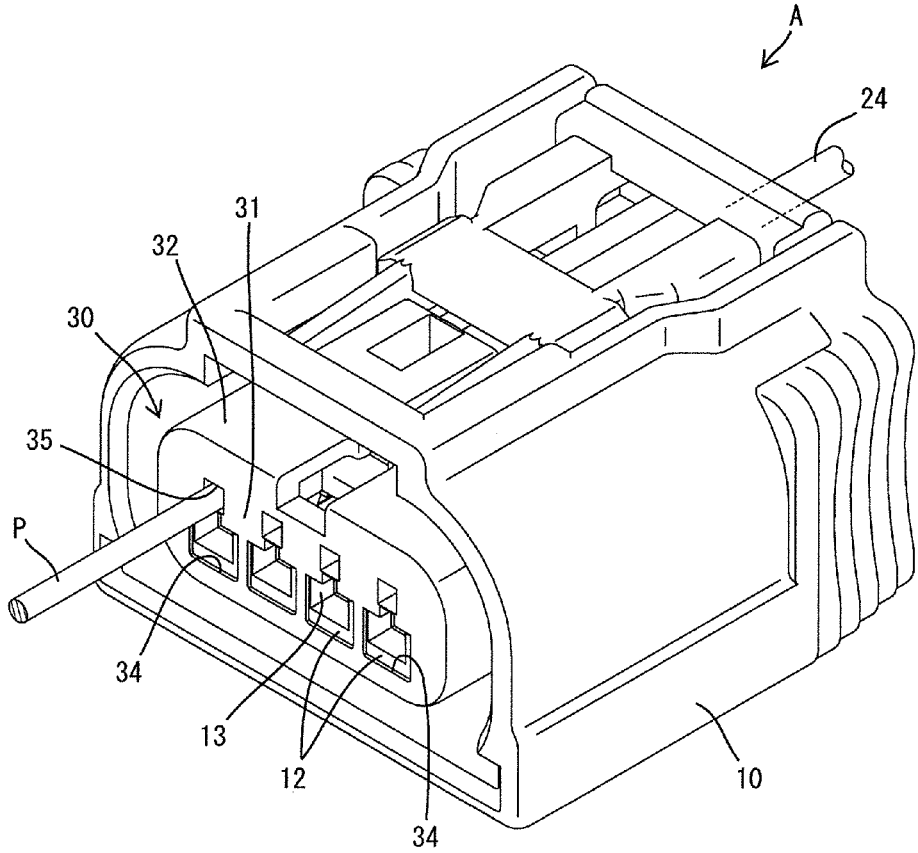
FIG. 1 is a perspective view of a connector according to embodiment 1 with a probe inserted.

A connector according to the present invention may be equipped with a restricting protrusion which is formed on the terminal fitting and arranged in front of a lock portion of the lance to the terminal fitting, and which comes into contact with a distal end of the probe inserted into the mold removal space.

In this connector, the probe inserted into the detection hole and the mold removal space comes into contact with the restricting protrusion before it reaches the lock portion of the lance to the terminal fitting, whereby the insertion is restricted. Thus, it is possible to avoid interference between the lock portion of the lance and the probe.

The restricting protrusion may be locked to the lance thereby preventing detachment of the terminal fitting.

In this connector, since the restricting protrusion is the object of locking for the lance, the configuration of the terminal fitting is simplified as compared with the case where the object of locking for the lance is formed separately from the restricting protrusion.

A connector according to the present invention may be equipped with: a guide portion formed in the front retainer and inclined such that an opposing distance between the guide portion and an outer surface of the terminal fitting is reduced toward a front side in an inserting direction of the probe; and a pair of guide surfaces which form the guide portion, a distance between the guide surfaces in a width direction, parallel to the outer surface of the terminal fitting and perpendicular to the inserting direction of the probe, being reduced toward the front side in the inserting direction of the probe.

In this construction, it is possible to prevent positional deviation of the probe in the width direction.

A connector according to the present invention may be equipped with: a restricting protrusion formed on the terminal fitting and configured to prevent detachment of the terminal fitting by being locked to the lance; and a guide portion formed in the front retainer and inclined such that the probe makes a pre-stopping before the probe comes into contact with the restricting protrusion in the probe insertion process.

In this construction, the distal end portion of the probe does not come into contact with the restricting protrusion, so that there is no fear of the restricting protrusion, which constitutes the locking means to the lance, being damaged by the probe.

Embodiment 1

In the following, embodiment 1 of the present invention will be described with reference to FIGS. 1 through 8. A connector A according to embodiment 1 of the present invention is equipped with a housing 10, a plurality of terminal fittings 20, and a front retainer 30. In the connector A, a conduction inspection is performed based on whether a circuit including the terminal fittings 20 is brought into conduction or not when a probe P is brought into contact with the terminal fittings 20.

The housing 10 is formed of synthetic resin, and molded by a mold (not shown) of a well-known form configured to be opened in the longitudinal direction. As shown in FIGS. 2 through 5, inside the housing 10, a plurality of terminal accommodation chambers 11, which extend through the housing 10 in the longitudinal direction, are formed side by side in a row in the width direction (lateral direction). In the housing 10, front surface walls 12 constituting the terminal accommodation chambers 11 are formed individually, one for each terminal accommodation chamber 11, so as to protrude forwards. A tab insertion hole 13 for inserting a tab of a mating terminal (not shown) from the front side is formed in each front surface wall 12 so as to extend therethrough.

Figure 3:
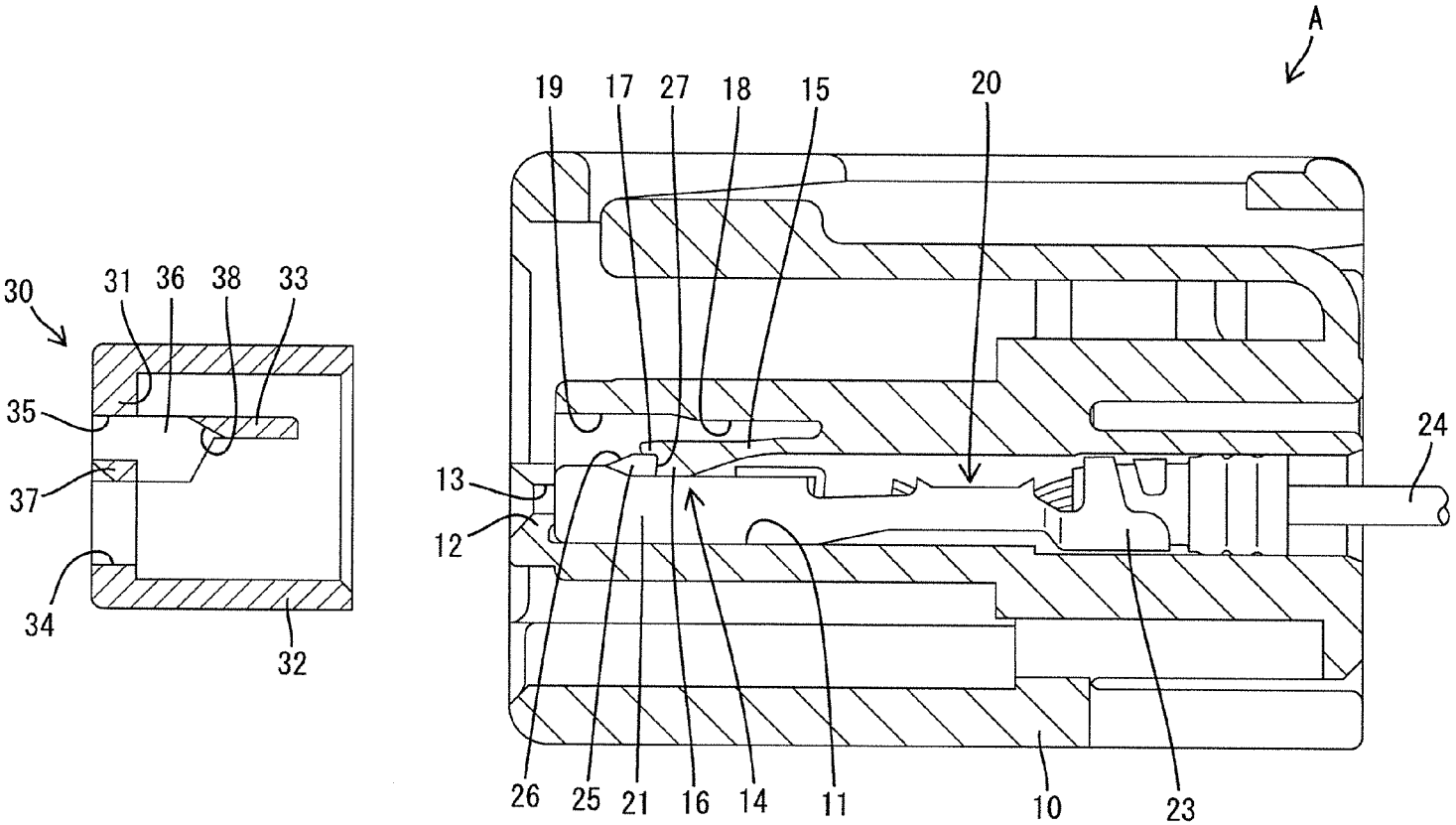
FIG. 3 is a sectional view of the connector with a front retainer removed from a housing thereof.
Figure 4:
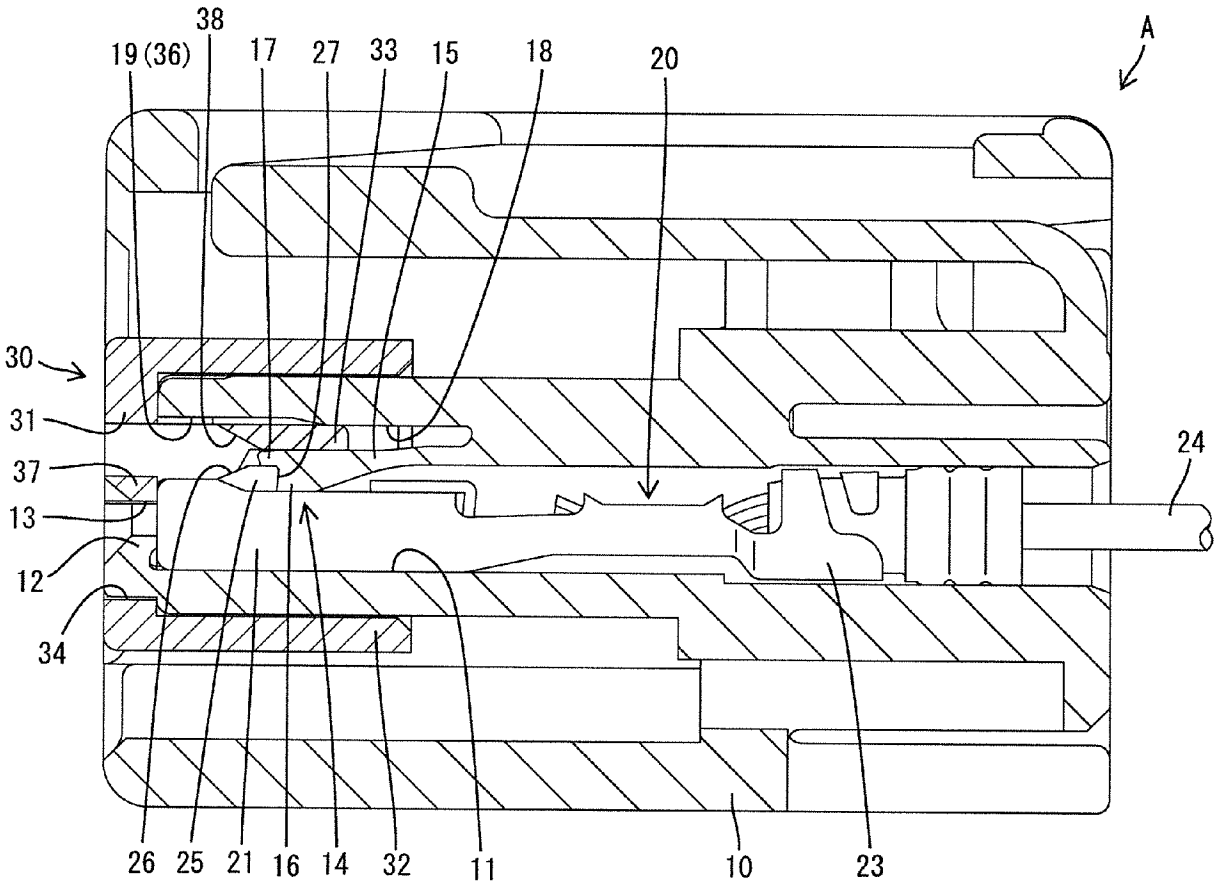
FIG. 4 is a sectional view of the connector with a terminal fitting inserted into the housing, and the front retainer mounted thereto.
Figure 5:
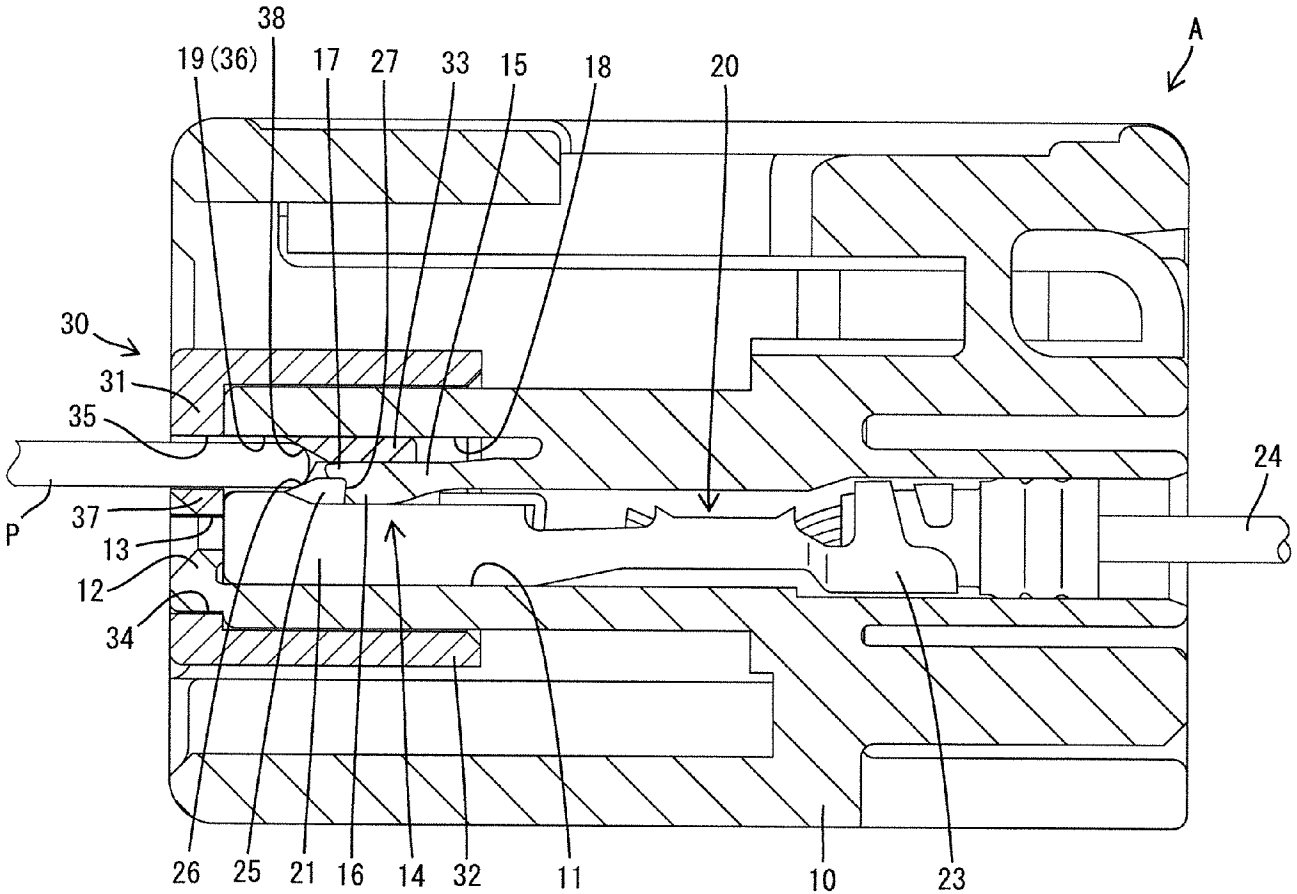
FIG. 5 is a sectional view of the connector with the probe inserted into the same.

As shown in FIGS. 3 through 5, the terminal fitting 20 is inserted into the terminal accommodation chamber 11 from the rear side (the right-hand side in FIGS. 3 through 5). A lance 14 which individually faces the terminal accommodation chamber 11 is formed on the upper wall portion constituting the terminal accommodation chamber 11. The lance 14 is integrally formed by a main body portion 15 extending forwards (the same direction as that in which the terminal fitting 20 is inserted into the terminal accommodation chamber 11) in a cantilever-like fashion, and a lock protrusion 16 (a lock portion of the lance to the terminal fitting 20 which is a constituent element of the present invention) protruding from the lower surface (the surface facing the terminal accommodation chamber 11) of the main body portion 15. The front end of the lock protrusion 16 is situated somewhat backwards from the front end of the main body portion 15. The front end portion (the portion in front of the lock protrusion 16) of the main body portion 15 functions as a jig lock portion 17 to which a jig (not shown) is locked for separating the lance 14 from the terminal fitting 20. The formation region of the lance 14 in the width direction extends over a range substantially the same as the entire width of the terminal accommodation chamber 11.

Figure 6:
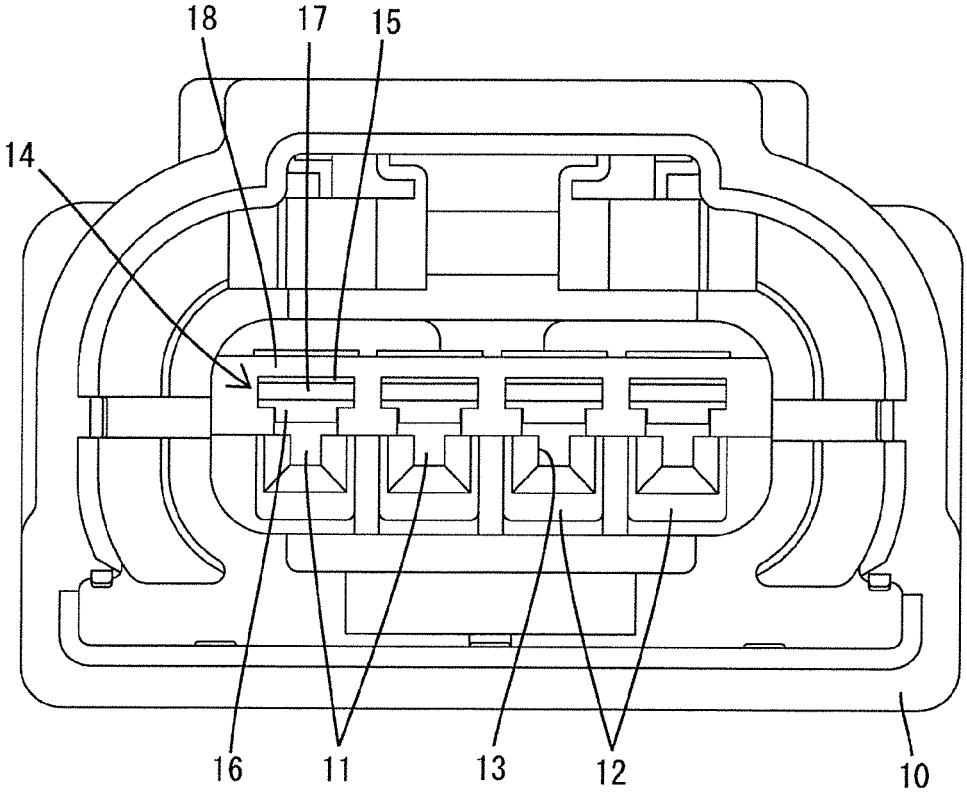
FIG. 6 is a front view of the housing.

Normally, the lance 14 is at the lock position shown in FIGS. 3 through 5; it can, however, undergo elastic deflection upwards (in a direction crossing the inserting direction of the terminal fitting 20 with respect to the terminal accommodation chamber, and in a direction in which it retracts from the terminal accommodation chamber 11) using the rear end portion of the main body portion 15 as a fulcrum. In the state where the lance 14 is at the lock position, the lower end of the lock protrusion 16 and the upper end of the terminal accommodation chamber 11 are situated at the same height in the vertical direction (a direction substantially parallel to the elastic deflection of the lance 14). Further, at the front end portion of the housing 10, there is formed a deflection space 18 for permitting upward elastic deflection of the lance 14 so as to be open in the front surface of the housing 10. As shown in FIG. 6, the deflection space 18 is not formed individually for each lance 14 but is continuous in the width direction so as to correspond to all the terminal accommodation chambers 11.

As shown in FIGS. 3 through 5, at the front end portion of the housing 10, a mold removal space 19, which is formed by a mold (not shown) forwardly opened when forming the lance 14, is formed so as to be open in the front surface of the housing 10. The mold removal space 19 functions as a conduction inspection means. The mold removal space 19 and the deflection space 18 are arranged longitudinally side by side, with the front end portion of the deflection space 18 communicating with the rear end portion of the mold removal space 19. Similarly, the mold removal space 19 and the lances 14 are also arranged longitudinally side by side, with the front end portion of the lance 14 facing the rear end portion of the mold removal space 19.

The formation region in the vertical direction of the mold removal space 19 is the range from the upper end of the deflection space 18 to the lower end of the lock protrusion 16 (i.e., the upper end of the terminal accommodation chambers 11) of the lance 14. Thus, the rear end side region of the mold removal space 19 excluding the front end portion (the end portion corresponding to the front surface wall 12 of the terminal accommodation chamber 11 in the longitudinal direction) communicates, at the lower surface thereof, with the upper surfaces of the front end portions of the terminal accommodation chamber 11. The mold removal space 19 is not formed individually for each lance 14, but is continuous in the width direction so as to correspond to all the terminal accommodation chambers 11.

Figure 8:
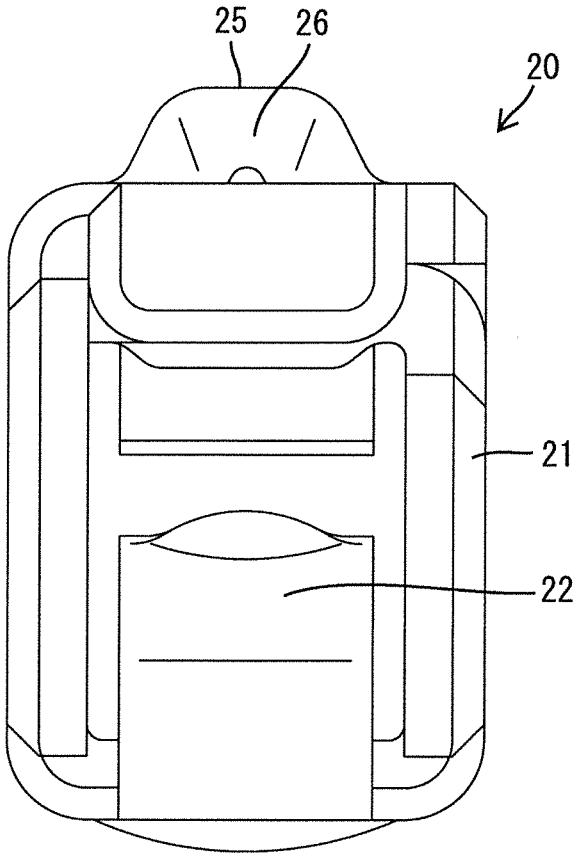
FIG. 8 is a front view of the terminal fitting.
Figure 9:
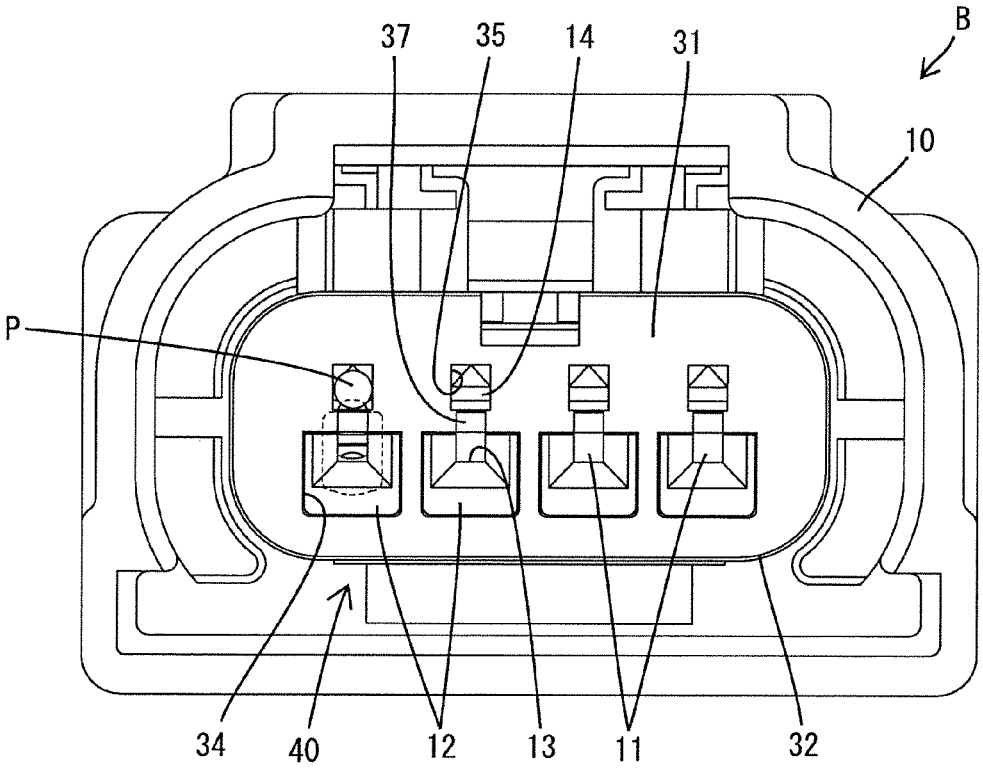
FIG. 9 is a front view of a connector according to embodiment 2.
Figure 10:
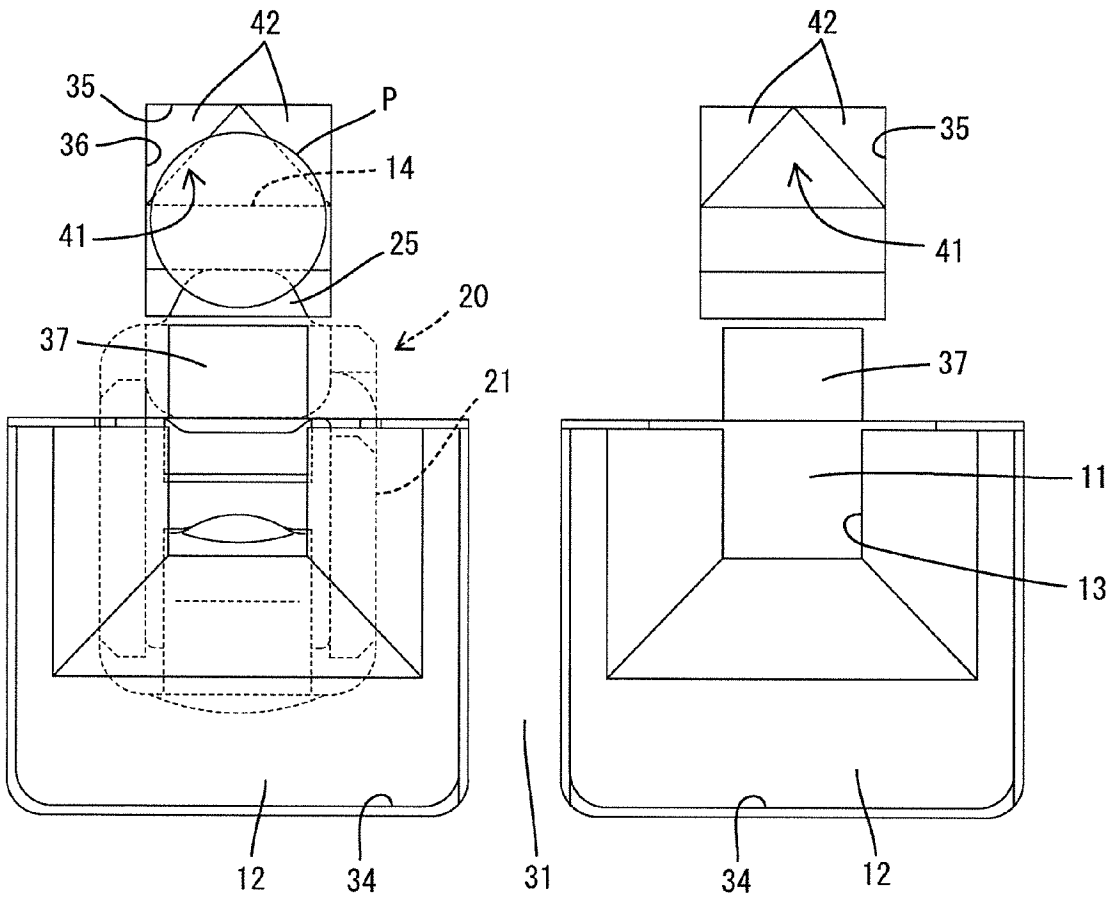
FIG. 10 is a partial enlarged view of FIG. 9.
Figure 11:
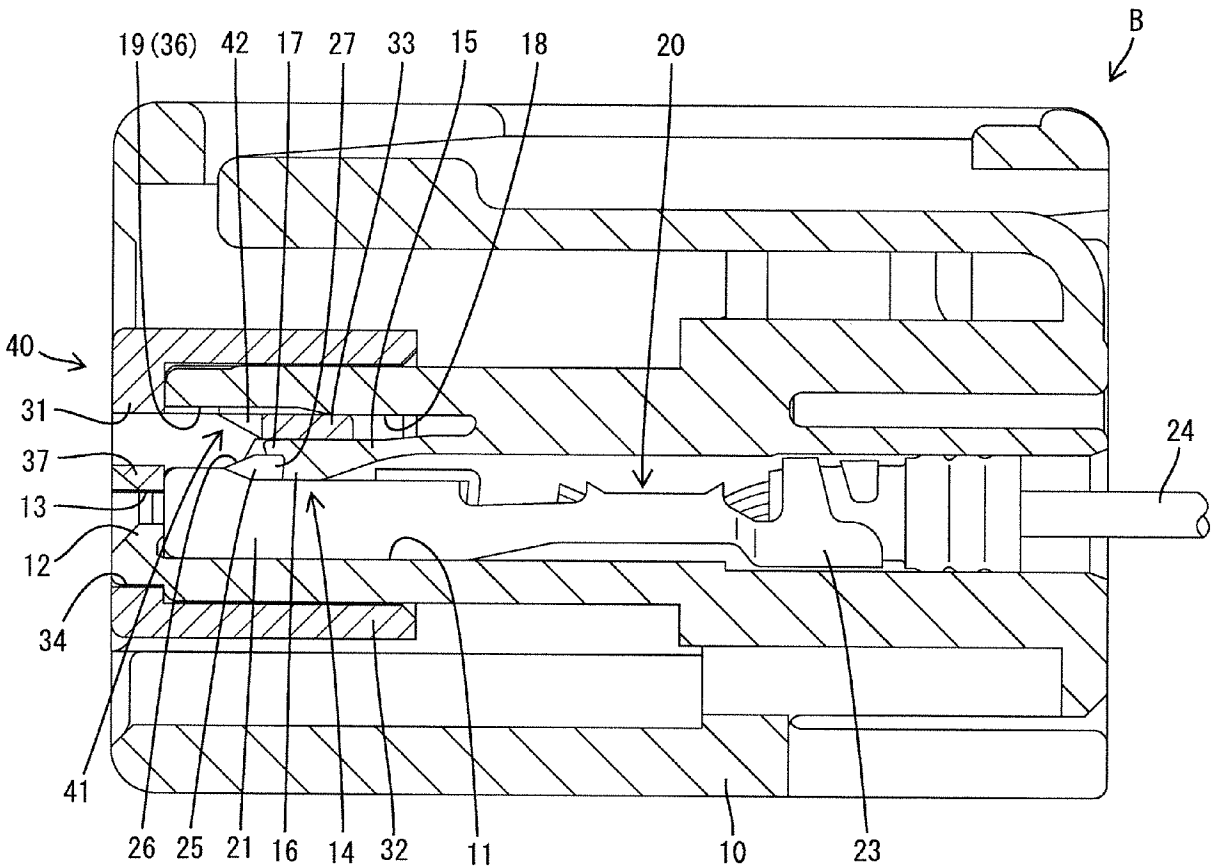
FIG. 11 is a sectional view of the connector with the terminal fitting inserted, and with the front retainer mounted thereto.
Figure 12:
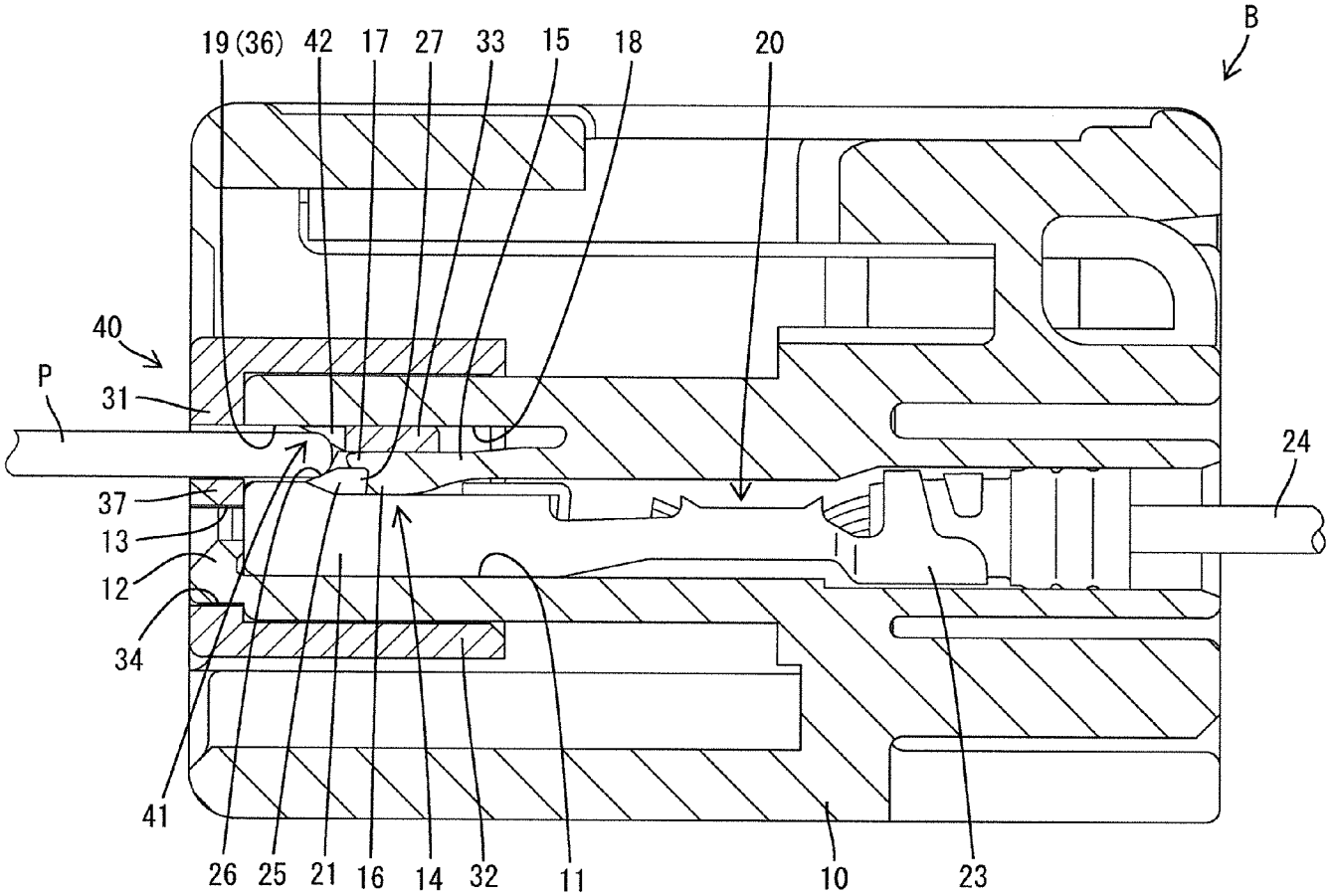
FIG. 12 is a sectional view of the connector with the probe inserted into the same.
Figure 13:
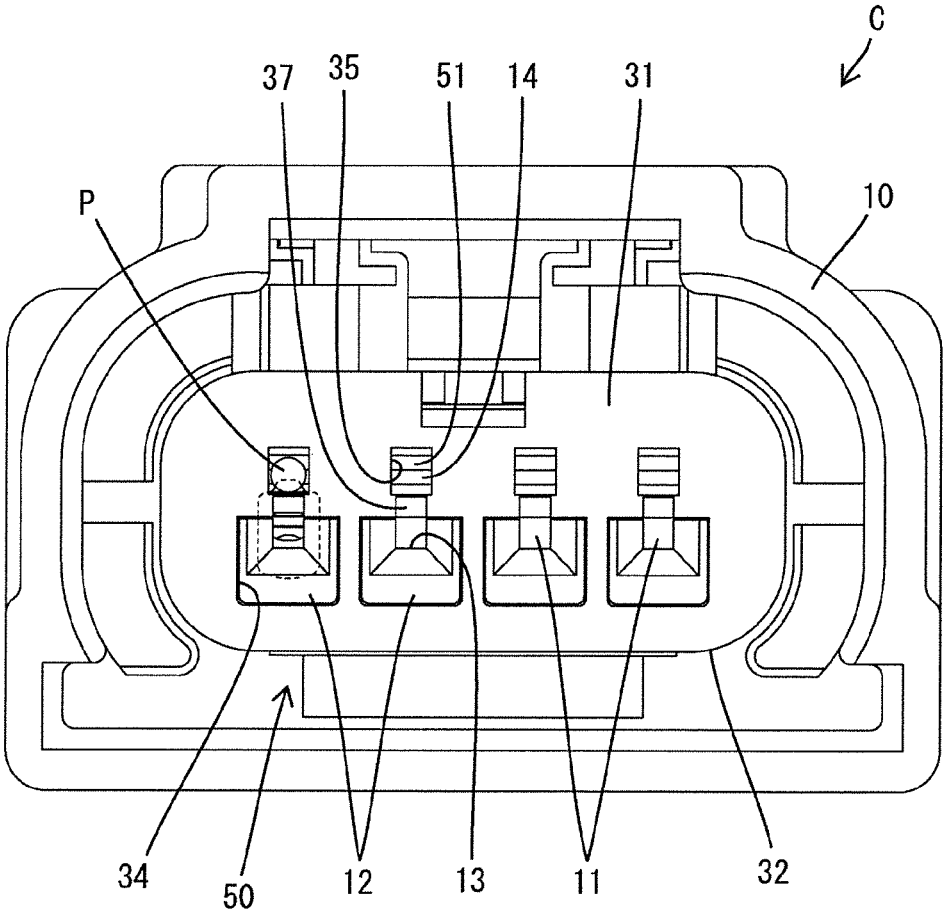
FIG. 13 is a front view of a connector according to embodiment 3.
Figure 14:
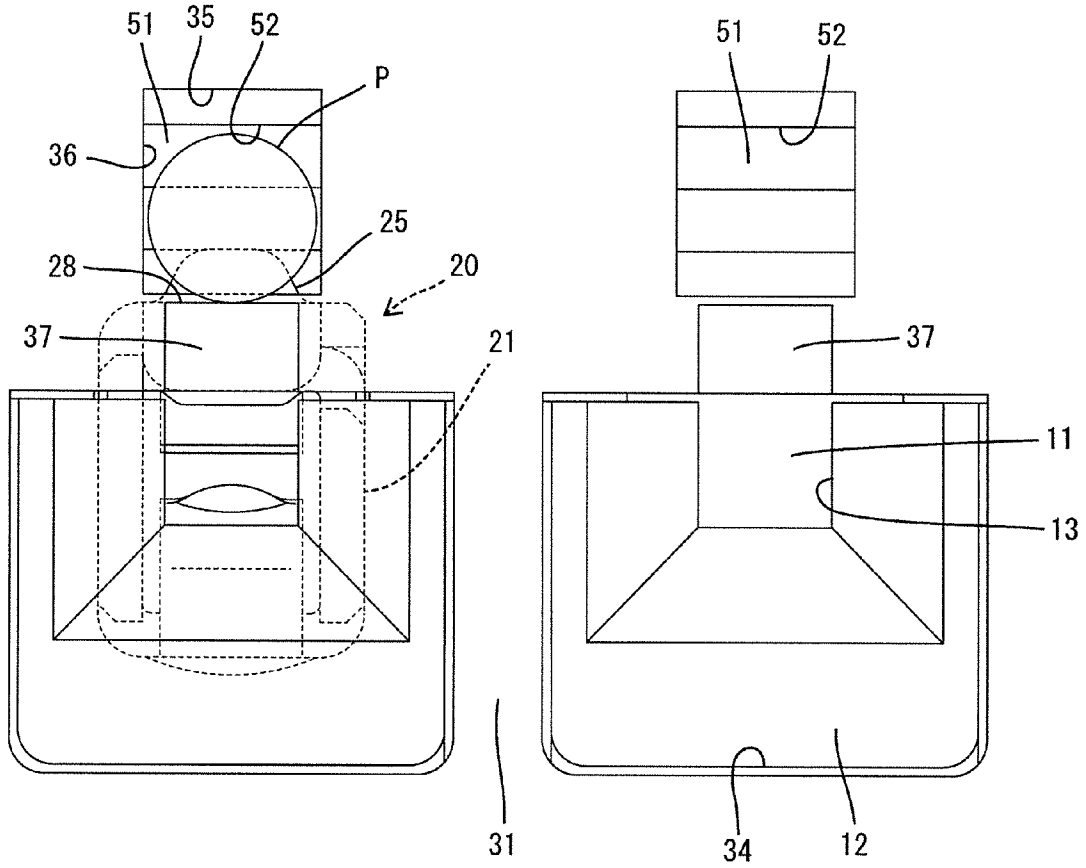
FIG. 14 is a partial enlarged view of FIG. 13.
Figure 15:
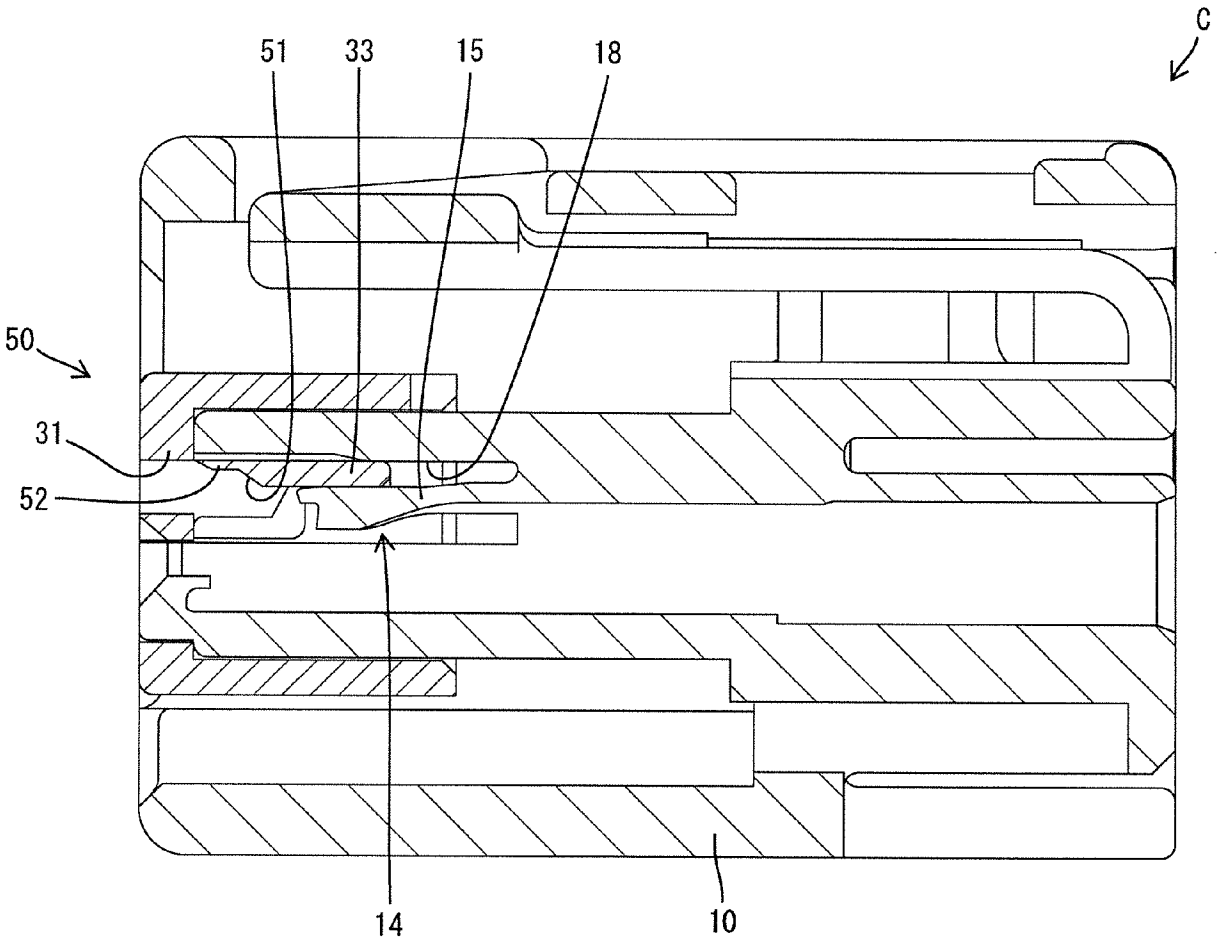
FIG. 15 is a sectional view of the connector with the front retainer mounted to the front retainer thereof.
Figure 16:
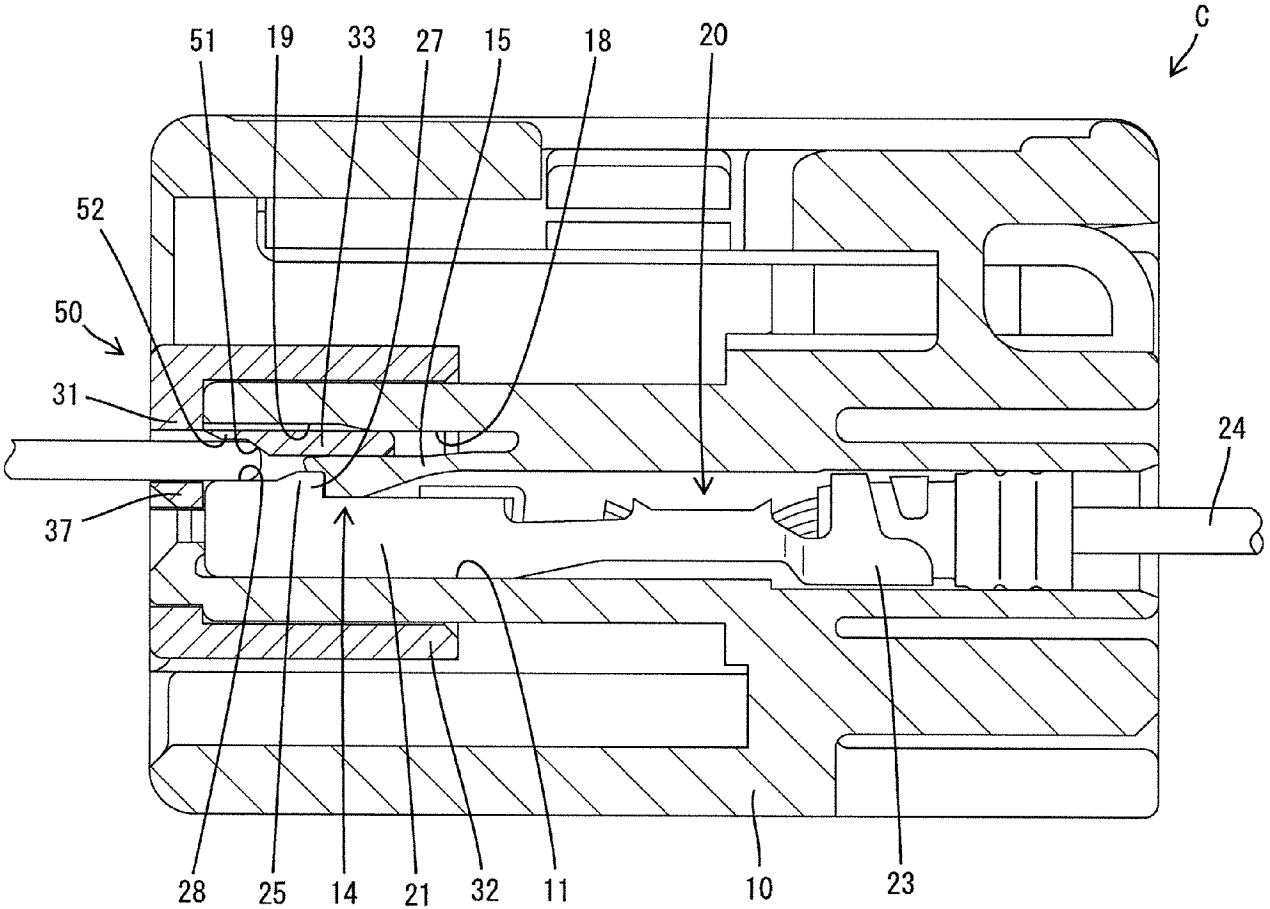
FIG. 16 is a sectional view of the connector with the probe inserted into the same.
Figure 17:
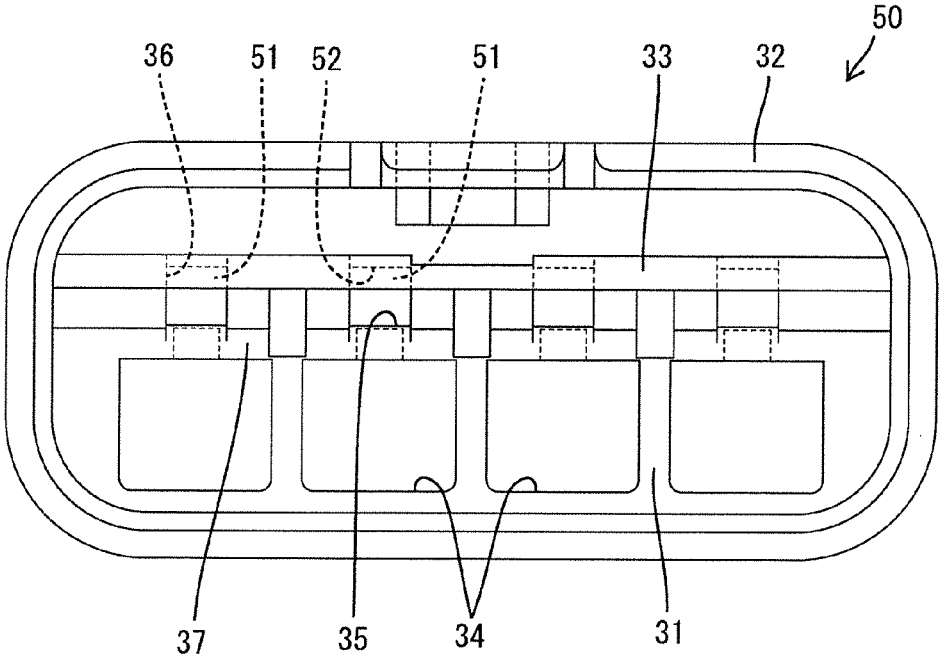
FIG. 17 is a rear view of the front retainer.

As shown in FIGS. 3 through 5, the terminal fitting 20 is female terminal thin and narrow in the longitudinal direction and having a rectangular tube portion 21 formed at the front end portion. The tab of the mating terminal (not shown) is inserted into the rectangular tube portion 21 from the front side. As shown in FIG. 8, inside the rectangular tube portion 21, there is provided an elastic contact member 22 configured to be elastically brought into contact with the tab inserted. As shown in FIGS. 3 through 5, an electric wire press-fitting portion 23 is formed at the rear end portion of the terminal fitting 20, and an electric wire 24 is connected to the electric wire press-fitting portion 23 by press-fitting.

As shown in FIGS. 3 through 5 and 8, there is formed a restricting protrusion 25 on the upper surface (the surface of the outer surface of the terminal fitting 20 facing the mold removal space 19) of the rectangular tube portion 21. The front surface of the restricting protrusion 25 is formed as an inclined surface 26 oblique with respect to the direction in which the terminal fitting 20 is inserted into the terminal accommodation chamber 11. The rear surface of the restricting protrusion 25 constitutes a lock surface 27 substantially perpendicular to the inserting direction of the terminal fitting 20. This restricting protrusion 25 is endowed with a detachment prevention function for preventing detachment of the terminal fitting 20 by the lance 14, and an interference avoiding function for avoiding interference between a probe P for conduction inspection described below and the lance 14.

As shown in FIGS. 3 through 5, the terminal fitting 20 is inserted into the terminal accommodation chamber 11 from the rear side of the housing 10. In the insertion process, the lock protrusion 16 of the lance 14 interferes with the restricting protrusion 25, and, due to the inclination of the inclined surface 26, the lance 14 is elastically deflected upwards to be accommodated in the deflection space 18. When the terminal fitting 20 reaches the normal insertion position, the restricting protrusion 25 passes the lock protrusion 16, so that the lance 14 is elastically restored downwards, and the lock protrusion 16 is locked to the lock surface 27 of the restricting protrusion 25 from the rear side. Due to this lock action, the terminal fitting 20 is maintained in a detachment prevention state. In the state where the terminal fitting 20 is inserted to the normal position, the upper surface of the rectangular tube portion 21 and the lower surface of the mold removal space 19 are situated at substantially the same height in the vertical direction, and the restricting protrusion 25 enters the mold removal space 19.

The front retainer 30 is formed of synthetic resin, and is mounted to the housing 10 from the front side thereof as shown in FIGS. 3 through 5. The front retainer 30 is integrally formed by a wall-like portion 31, a cylindrical fitting portion 32 extending backwards from the outer peripheral edge of the wall-like portion 31, and a restricting portion 33 extending backwards from the wall-like portion 31. The wall-like portion 31 is mounted so as to cover the range including the formation regions of the all the terminal accommodation chambers 11 of the front surface of the housing 10.

As shown in FIGS. 2 through 5 and 7, the wall-like portion 31 has a plurality of insertion ports 34 corresponding to the terminal accommodation chambers 11. In the state where the front retainer 30 is mounted to the housing 10, the insertion ports 34 are fit-engaged with the corresponding front wall surfaces 12. The tab passes a tab insertion hole 13 exposed in the insertion port 34, and is inserted into the rectangular tube portion 21 in the terminal accommodation chamber 11. The restricting portion 33 is in the form of a plate, and is fitted into the deflection space 18 in the state where the front retainer 30 is mounted to the housing 10. As shown in FIGS. 3 through 5, when the restricting portion 33 is fitted into the deflection space 18, the lance 14 is restricted from the elastic deflection toward the deflection space 18 side (upwards), and the lock protrusion 16 is maintained in the state where it is locked to the restricting protrusion 25 of the terminal fitting 20 from the rear side. That is, due to the restricting portion 33, the reliability of the detachment prevention function for the terminal fitting 20 by the lance 14 is enhanced.

Figure 2:
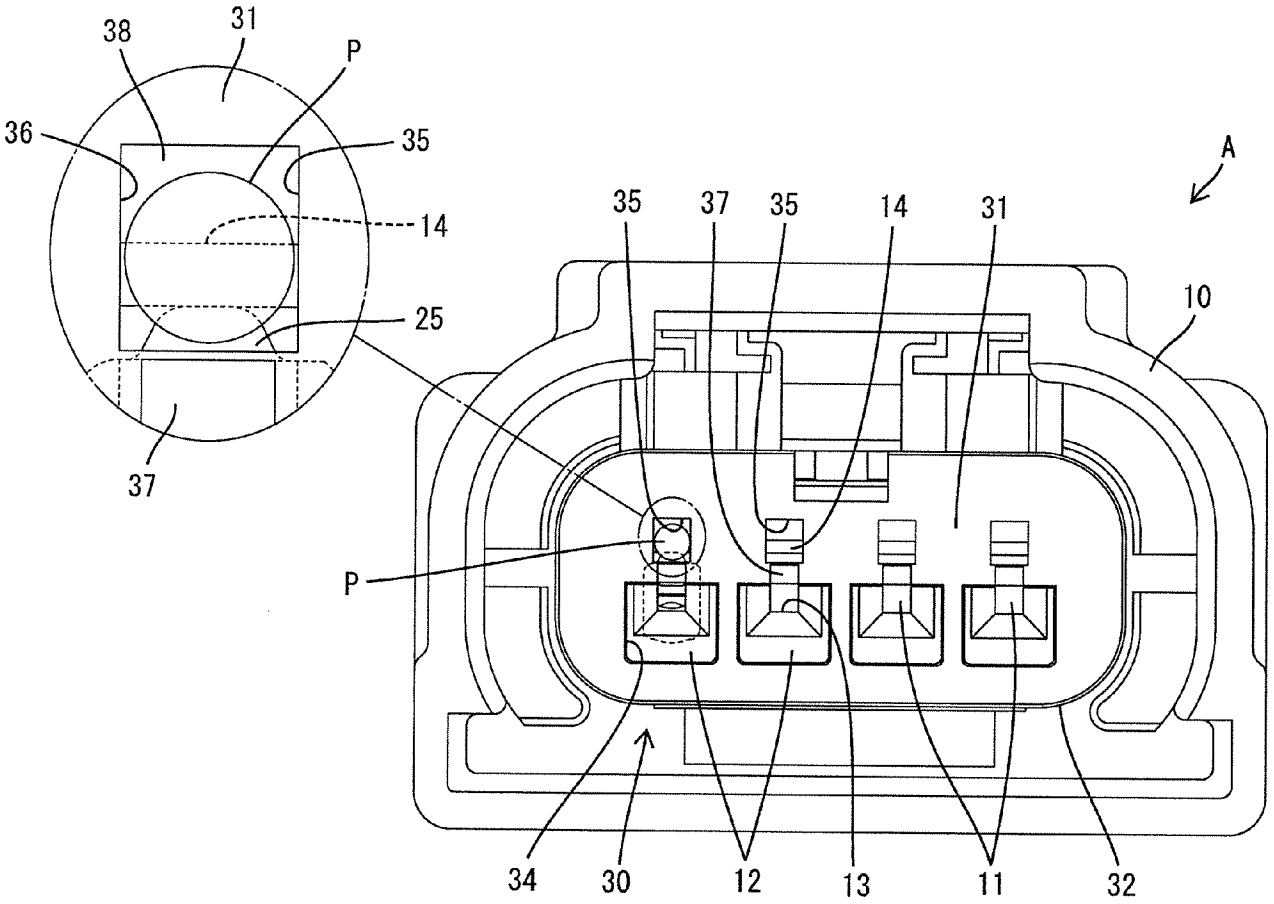
FIG. 2 is a front view of the connector.
Figure 7:
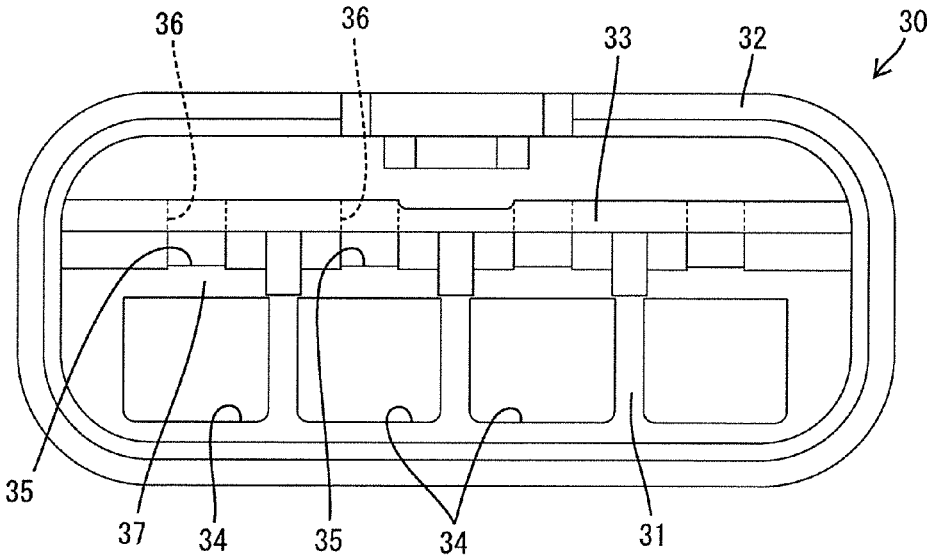
FIG. 7 is a rear view of the front retainer.

As shown in FIGS. 3 through 5, the front retainer 30 has, in a longitudinally arranged state, a plurality of detection holes 35 extending longitudinally through the wall-like portion 31, and a plurality of cutouts 36 formed by cutting the front end side region of the restricting portion 33 and individually communicating with the detection holes 35. The plurality of detection holes 35 are arranged so as to be situated above the insertion ports 34 with a partition wall portion 37 therebetween. As shown in FIGS. 2 and 7, the detection hole 35 is of a rectangular opening configuration. The cutout 36 is cut out so as to establish communication between the upper surface and the lower surface of the restricting portion 33. As shown in FIGS. 3 through 5, the opening region of the detection hole 35 and the formation region of the cutout 36 in the vertical direction are substantially the same range as the formation range of the mold removal space 19. That is, the upper end of the detection hole 35 and of the cutout 36 and the upper end (upper surface) of the restricting portion 33 are situated at the same height in the vertical direction.

Further, as shown in FIG. 7, in the width direction, the opening dimension of the detection hole 35 and the width dimension of the cutout 36 are of the same dimension, and the formation region of the detection hole 35 and the formation region of the cutout 36 are also the same range. The width dimension of the detection hole 35 and the cutout 36 is smaller than the width dimension of the terminal accommodation chamber 11 and of the lance 14. The detection hole 35 and the cutout 36 are arranged at the central position in the width direction of the corresponding terminal accommodation chamber 11 and lance 14. As shown in FIGS. 3 through 5, at the depth end portion (rear end portion) of the cutout 36, there is formed guide portion 38 having the upper surface (the ceiling surfaces facing the terminal accommodation chamber 11 in the state where the front retainer 30 is mounted to the housing 10) which is inclined so as to be lowered toward the rear side. The guide surface 38 is formed as a single flat surface. The inclination of the guide surface 38 is such that the opposing distance between itself and the outer surface of the terminal fitting 20 (the upper surface of the rectangular tube portion 21) is reduced toward the front side in the inserting direction of the probe P.

Next, the operation of embodiment 1 will be described. In assembling the connector A, at first, the front retainer 30 is not mounted on the housing 10, and, in this state, the terminal fitting 20 is inserted into the terminal accommodation chamber 11, and the lock protrusion 16 of the lance 14 is locked to the restricting protrusion 25 of the terminal fitting 20, whereby the terminal fitting 20 is prevented from being detached. After this, the front retainer 30 is mounted to the housing 10, and the restricting portion 33 is fitted into the deflection space 18, whereby the elastic deflection of the lance 14 away from the terminal fitting 20 is restricted, thereby reliably preventing the terminal fitting 20 from being detached. At this time, both the right and left portions of the cutout 36 of the restricting portion 33 are locked to or brought close to face the main body portion 15 of the lance 14 from above. In this way, the connector A is assembled.

In the state where the connector A is assembled (in the state where the front retainer 30 is mounted to the housing 10), the detection hole 35 of the front retainer 30 communicate with the front end portion of the mold removal space 19, and the cutout 36 is arranged in the mold removal space 19. Further, in the longitudinal direction, the rear end of the guide portion 38 is situated somewhat in front of the front ends of the main body portion 15 of the lance 14. And, in the vertical direction, the entire guide portion 38 faces the terminal accommodation chamber 11 via the mold removal space 19, and the entire guide portion 38 faces the inclined surface 26 of the restricting protrusion 25 of the terminal fitting 20.

In this state, the conduction inspection is performed, and the probe P is inserted into the connector A from the front side. The inserting direction of the probe P is substantially parallel to the direction in which the terminal fitting 20 is inserted into the terminal accommodation chamber 11, and the inserting direction of the probe P and the inserting direction of the terminal fitting 20 are opposite each other in the longitudinal direction. The distal end portion (the front end portion in the inserting direction) of the probe P passes the detection hole 35 and enters the mold removal space 19 (i.e., the cutout 36) to abut the guide portion 38. The probe P having abutted the guide portion 38 is guided so as to be downwardly displaced (i.e., toward the terminal accommodation chamber 11 side) due to the inclination of the guide portion 38, so that it reliably abuts the upper surface of the rectangular tube portion 21 of the terminal fitting 20 in the terminal accommodation chamber 11.

In this way, the distal end portion of the probe P abuts the guide portion 38 from below, and abuts the upper surface of the rectangular tube portion 21 from above, thus abutting the connector A at two, upper and lower, positions. The distal end portion of the probe P held vertically between the guide portion 38 and the rectangular tube portion 21 is set in position (restricted in movement) in the vertical direction.

Further, in the longitudinal direction, even if there occurs amounting error of the terminal fitting 20 in the terminal accommodation chamber 11 or a mounting error of the front retainer 30 with respect to the housing 10, whereby the guidance by the guide portion 38 may be insufficient, the distal end portion of the probe P abuts the inclined surface 26 since the restricting protrusion 25 of the terminal fitting 20 is located at the position facing the guide portion 38.

As described above, in the connector A of embodiment 1, the terminal fitting 20 is accommodated in the terminal accommodation chamber 11 formed in the housing 10; the terminal fitting 20 is prevented from detachment by the lance 14 formed so as to extend forwards in a cantilever-like fashion along the inner wall surface of the terminal accommodation chamber 11; and, due to the front retainer 30 mounted to the housing 10 so as to cover the front surface thereof, the lance 14 is maintained in the state where it is locked to the terminal fitting 20. Further, the connector A is equipped with: the mold removal space 19 formed in the housing 10, opened in the front surface of the housing 10, communicating with the terminal accommodation chamber 11, and serving to mold the lance 14; the detection hole 35 formed in the front retainer 30, allowing insertion of the probe P for conduction inspection from the front side of the front retainer 30, and communicating with the terminal accommodation chamber 11 via the mold removal space 19; and the guide portion 38 formed in the front retainer 30, and configured to guide the probe P inserted into the detection hole 35 and the mold removal space 19 to a position in the terminal accommodation chamber 11 where the probe P abuts outer surface of the terminal fitting 20.

In this way, the connector A of embodiment 1 utilizes the existing mold removal space 19 formed in order to mold the lance 14 as the means for establishing communication between the detection hole 35 of the front retainer 30 and the terminal accommodation chamber 11, so that there is no need to newly form a communication hole dedicated to the probe P in the housing 10. Thus, it is possible to prevent the configuration of the housing 10 from becoming complicated.

Further, the connector A of embodiment 1 is equipped with restricting protrusion 25 formed on the terminal fitting 20, arranged in front of the lock portion (lock protrusion 16) of the lances 14 to the terminal fitting 20, and configured to be brought into contact with the distal end of the probe P inserted into the mold removal space 19. In this construction, the probe P inserted into the detection hole 35 and the mold removal space 19 comes into contact with the restricting protrusion 25 before reaching the lock protrusion 16 of the lance 14 to be thereby restricted from its insertion, so that it is possible to avoid interference between the lock protrusion 16 and the probe P. Further, the restricting protrusion 25 is locked to the lance 14, thereby preventing detachment of the terminal fitting 20. That is, the restricting protrusion 25 constitutes the object of locking with respect to the lance 14. Thus, as compared with the case where an object of locking for the lance 14 is formed separately from the restricting protrusion 25, the configuration of the terminal fitting 20 is simplified.

Embodiment 2

Next, embodiment 2 of the present invention will be described with reference to FIGS. 9 through 12. In a connector B according to the present embodiment 2, a guide portion 41 formed in a front retainer 40 is of a different configuration from that of embodiment 1. Otherwise, the present embodiment is of the same construction as embodiment 1, so the same components are indicated by the same reference numerals, and a description of the structure, operation, and effects will be eliminated.

The guide portion 38 of embodiment 1 is formed as a single flat surface, whereas the guide portion 41 of embodiment 2 is formed by a pair of right and left symmetrical flat guide surfaces 42. The pair of guide surfaces 42 are inclined such that distance between them in the width direction (the direction parallel to the upper surface of the rectangular tube portion 21 and perpendicular to the inserting direction of the probe P) is gradually reduced toward the front side of the inserting direction of the probe P, that is, toward the depth (the rear side) of the mold removal space 19. Further, in the vertical direction (the direction substantially orthogonal to the inserting direction of the probe P and orthogonal to the upper surface of the rectangular tube portion 21), the pair of guide surfaces 42 are inclined such that the distance between themselves and the upper surface of the rectangular tube portion 21 is gradually reduced toward the front side of the inserting direction of the probe P.

When the probe P is inserted into the mold removal space 19, the distal end portion (the front end portion in the inserting direction) of the probe P abuts the pair of guide surfaces 42. The probe P in contact with the guide portion 41 is guided so as to be displaced downwards (i.e., toward the terminal accommodation chamber 11) due to the inclination of the guide surfaces 42, so that it reliably abuts the upper surface (the portion of the outer surface of the terminal fitting 20 facing the mold removal space 19) of the rectangular tube portion 21 of the terminal fitting 20 within the terminal accommodation chamber 11.

In this way, the distal end portion of the probe P abuts the pair of guide surfaces 42 from below and abuts the upper surface of the rectangular tube portion 21 from above thereby to be vertically held between the guide portion 41 and the rectangular tube portion 21, so that it is set in position (restricted in movement) in the vertical direction. Further, the distal end portion of the probe P abuts the pair of the pair of right and left symmetrical guide surfaces 42, so that it is set in position (restricted in movement) in the lateral direction (width direction). In this way, in embodiment 2, the distal end portion of the probe P abuts the connector B at three positions: the pair of guide surfaces 42 and the upper surface of rectangular tube portion 21.

Embodiment 3

Next, embodiment 3 of the present invention will be described with reference to FIGS. 13 through 17. In the connectors A and B according to embodiments 1 and 2, the probe P is caused to abut the restricting protrusion 25 formed on the upper surface of the rectangular tube portion 21, whereas, in a connector C according to embodiment 3, the probe P is not caused to come into contact with the restricting protrusion 25, but is caused to come into contact with the region of the upper surface of the rectangular tube portion 21 (the portion of the outer surface of the terminal fitting 20 facing the mold removal space 19) where the restricting protrusion 25 is not formed. The region of the upper surface of the rectangular tube portion 21 coming into contact with the probe P is a contact region 28 arranged in front of the restricting protrusion 25 (in the rear of the restricting protrusion 25 in the inserting direction of the probe P with respect to the connector C). This contact region 28 is a flat surface perpendicular to the direction in which the probe P abuts the terminal fitting 20 and parallel to the inserting direction of the probe P.

Further, in the front retainer 30, 40 of the embodiment 1, 2, the guide portion 38, 41 formed on the restricting portion 33 is arranged at a position corresponding to the restricting protrusion 25 in the longitudinal direction. In contrast, in a front retainer 50 according to embodiment 3, a guide portion 51 of the restricting portion 33 is arranged in front of the restricting protrusion 25 of the terminal fitting 20 (in the region corresponding to the contact region 28 in the longitudinal direction).

As in the case of the guide portion 38 of embodiment 1, the guide portion 51 is formed as a flat surface downwardly inclined toward the rear side (that is, inclined such that the vertical distance between itself and the contact region 28 is gradually reduced toward the rear side). The orientation of the inclination of the guide portion 51 is parallel to the inserting direction of the probe P in a projection plane parallel to the contact region 28. Further, the guide portion 51 is inclined such that, in the insertion process of the probe P, the probe P makes a pre-stopping before coming into contact with the restricting protrusion 25.

Further, in the front retainer 30, 40 of embodiment 1, 2, the region of the restricting portion 33 in front of the guide portion 38, 41, consists of the cutout 36 extending vertically through the restricting portion 33. In contrast, in embodiment 3, the region of the lower surface of the restricting portion 33 in front of the guide portion 51 consists of a presser surface 52 facing the upper surface of the rectangular tube portion 21. The distance between the presser surface 52 and the upper surface of the rectangular tube portion 21 is set to a dimension somewhat larger than the outer diameter of the probe P. The presser surface 52 restricts the probe P from largely displaced upward (moving away from the contact region 28).

At the time of conduction inspection, the probe P is inserted into the connector C from the front side. The distal end portion (the front end portion in the inserting direction) of the probe P passes the detection hole 35 and enters the mold removal space 19 (that is, into the cutout 36) before abutting the guide portion 51. The probe P having abutted the guide portion 51 is guided so as to be displaced downwardly (that is, toward the terminal accommodation chamber 11 side) due to the inclination of the guide portion 51, so that the probe reliably abuts the upper surface (contact region 28) of the rectangular tube portion 21 of the terminal fitting 20 in the terminal accommodation chamber 11. The probe P is of a substantially columnar configuration, so that the contact between the contact region 28 and the probe P is line contact.

In the state where the probe P is in contact with the contact region 28, the distal end portion of the probe P does not reach the restricting protrusion 25. Thus, the restricting protrusion 25, which constitutes the locking means with respect to the lance 14, does not suffer damage or deformation by the probe P. Further, the distal end portion of the probe P abuts the guide portion 51 from below, and abuts the contact region 28 from above, which means it is in contact with the connector C at two positions. The distal end portion of the probe P held vertically between the guide portion 51 and the contact region 28 is set in position (restricted in movement) in the vertical direction.

Further, the contact region 28 is a flat surface perpendicular to the direction in which the probe P abuts the terminal fitting 20. And, the orientation of the inclination of the guide portion 51 is parallel to the inserting direction of the probe P in a projection plane parallel to the contact region 28. Thus, even when the terminal fitting 20 and the probe P make relative displacement in the lateral direction (the direction perpendicular to both the inserting direction of the probe P and the direction in which the probe P abuts the terminal fitting 20), there is no fear of the contact state of the probe P and the contact region 28 being changed.

Apart from the above, the present embodiment is of the same construction as embodiment 1 described above, so the same components are indicated by the same reference numerals, and a description of the structure, operation, and effects thereof are eliminated.

Other Embodiments

The present invention is not restricted to the embodiments described above with reference to the drawings; the technical scope of the present invention also covers, for example, the following embodiments.

(1) While in the above embodiments 1, 2, and 3 the restricting protrusion is locked to the lance, it is also possible for the restricting protrusion not to be locked to the lance.

(2) While in the above embodiments 1, 2, and 3 the interference between the lance and the probe is avoided by forming the restricting protrusion on the terminal fitting, it is also possible for the restricting protrusion not to be formed on the terminal fitting.

The invention claimed is:

1. A connector comprising:

a housing having a terminal accommodation chamber;

a terminal fitting accommodated in the terminal accommodation chamber, a restricting protrusion being formed on the terminal fitting;

a lance cantilevered forwards along an inner wall surface of the terminal accommodation chamber and configured to lock the restricting protrusion of the terminal fitting in a detachment prevention state;

a front retainer mounted to the housing so as to cover a front surface of the housing and configured to maintain the lance in a state where the lance is locked to the terminal fitting;

a mold removal space formed in the housing at a time of molding the lance and opened in the front surface of the housing, and which communicates with the terminal accommodation chamber and allows entrance of a probe for conduction detection;

a guide portion formed in the front retainer and being inclined so that the probe makes a pre-stopping before the probe contacts the restricting protrusion in a probe insertion process; and a detection hole formed in the front retainer, arranged longitudinally side by side with the mold removal space, allowing insertion of the probe from a front side of the front retainer, and communicating with the terminal accommodation chamber via the mold removal space.

2. The connector according to claim 1, wherein the restricting protrusion is arranged in front of a lock portion of the lance to the terminal fitting, and the restricting portion contacts a distal end of the probe inserted into the mold removal space.

3. The connector according to claim 2, wherein the restricting protrusion is locked to the lance thereby preventing detachment of the terminal fitting.

4. The connector according to claim 1, further comprising:

a pair of guide surfaces that form the guide portion, a distance between the guide surfaces in a width direction, parallel to the outer surface of the terminal fitting and perpendicular to the inserting direction of the probe, being reduced toward the front in the inserting direction of the probe.

* * * * *